United States Patent [19]

Ohta et al.

[11] Patent Number: 4,596,057

[45] Date of Patent: Jun. 24, 1986

[54] DRAINING PLUG DEVICE

[76] Inventors: Ikumi Ohta, 2800-31, Oaza Nao, Asahi-cho, Mie-gun, Mie-ken; Shinobu Ito, 1203-1, Oaza Biroku, Tado-cho, Kuwana-gun, Mie-ken, both of Japan

[21] Appl. No.: 575,561

[22] Filed: Jan. 31, 1984

[51] Int. Cl.[4] ..... E03C 1/23

[52] U.S. Cl. ..... 4/203; 4/295

[58] Field of Search ..... 4/203, 295

[56] References Cited

U.S. PATENT DOCUMENTS

| | | | |
|---|---|---|---|
| 948,033 | 2/1910 | Allingham | 4/203 |
| 1,710,289 | 4/1929 | Bresler | 4/203 |
| 2,009,224 | 7/1935 | Farrar | 4/203 X |
| 2,137,496 | 11/1938 | Klein | 4/203 |
| 2,179,121 | 11/1939 | Frank et al. | 4/203 |
| 3,428,295 | 2/1969 | Downey et al. | 4/295 X |
| 3,763,504 | 10/1973 | Parsons | 4/203 |

FOREIGN PATENT DOCUMENTS

| | | | |
|---|---|---|---|
| 1365438 | 5/1964 | France | 4/203 |

*Primary Examiner*—Charles E. Phillips

*Attorney, Agent, or Firm*—Wenderoth, Lind & Ponack

[57] ABSTRACT

A draining plug device includes a plug lid which opens and closes a draining port and is installed on a support provided in a water drainage cylinder, a remote operating portion which is directly connected to the support and the plug lid by means of a flexible wire-like connection, and an opening and closing holding mechanism which provides guidance and support so that an operational force generated by pushing down on the remote operating portion is transmitted to the support and the plug lid. The plug lid can be alternated between an opened state and a closed state by pushing down on the operating portion.

1 Claim, 9 Drawing Figures

DRAINING PLUG DEVICE

BACKGROUND OF THE INVENTION

This invention relates to a draining plug which is used in a wash basin, a bathtub or the like, more particularly to a draining plug device which opens and closes a draining hole by a plug lid which moves up and down in a draining pipe together with an operating portion when the operating portion is operated in a certain direction.

The basic draining plug device of this kind is shown in FIG. 1. A draining cylinder 3 is provided in a water vessel 2 of a water vessel body 1. A support 5 which supports the plug lid 4 is provided inside the draining cylinder 3.

The operating portion which projects from the water vessel body 1 is secured to an arm 9. The arm 9 and the above mentioned support 5 are connected to a lever 8 which rotates centering on a shaft 7. Thus, when the operating portion 6 is pushed down, the plug lid 4 moves upward and the water is drained. When the operating portion 6 is pulled up, the plug lid 4 moves downward and stops water drainage.

However, the conventional structure as mentioned above has a defect that as the connecting portion between the support 5 and the lever 8 and the connecting portion between the lever 8 and the arm 9 are subject to wear and malfunctin. Further, these connecting portions collide with each other when they are operated and generate large noises and operational forces.

This invention eliminates such defects as mentioned above and aims to provide an excellent water tight draining device having accuracy in closing and opening a plug, in which the operation of the connecting portion between the support and operating portion is smooth, does not cause wear, requires a small operational force, and does not make any impact noise when operated.

BRIEF DESCRIPTION OF THE DRAWINGS

This invention will now be described hereunder with reference to one of the embodiments, shown on the accompanying drawings, in which.

DETAILED DESCRIPTION OF THE PREFERRED EMBODIMENTS

Figure 1:
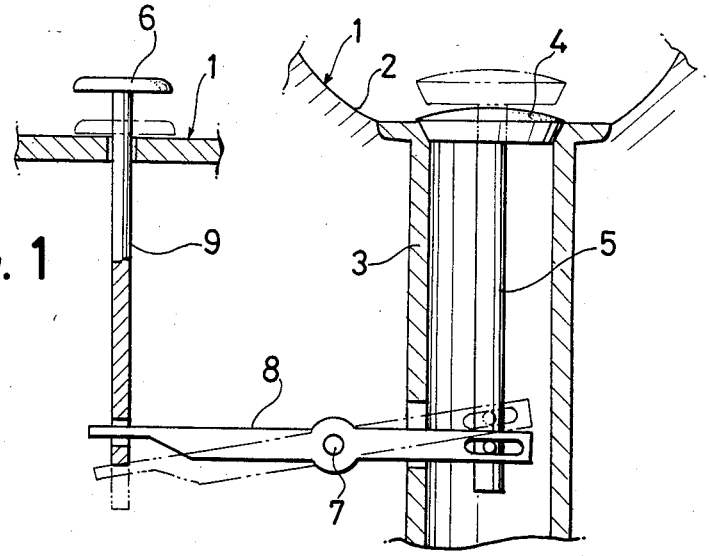
FIG. 1 is a vew outlining an example of a conventional draining plug device.
Figure 4:
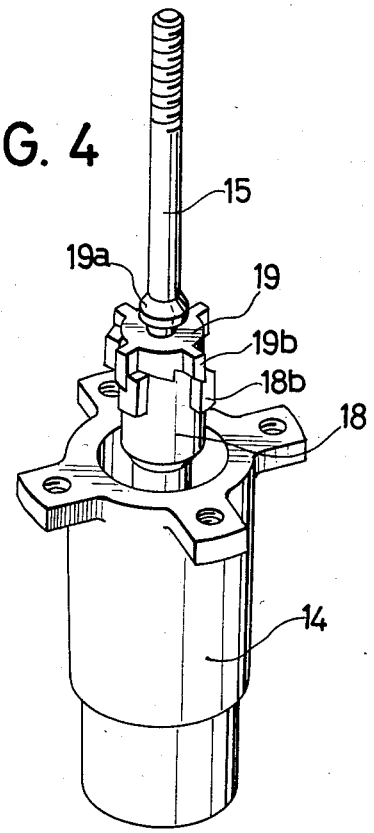
FIG. 4 is a perspective view showing a holding mechanism of the invention.
Figure 2:
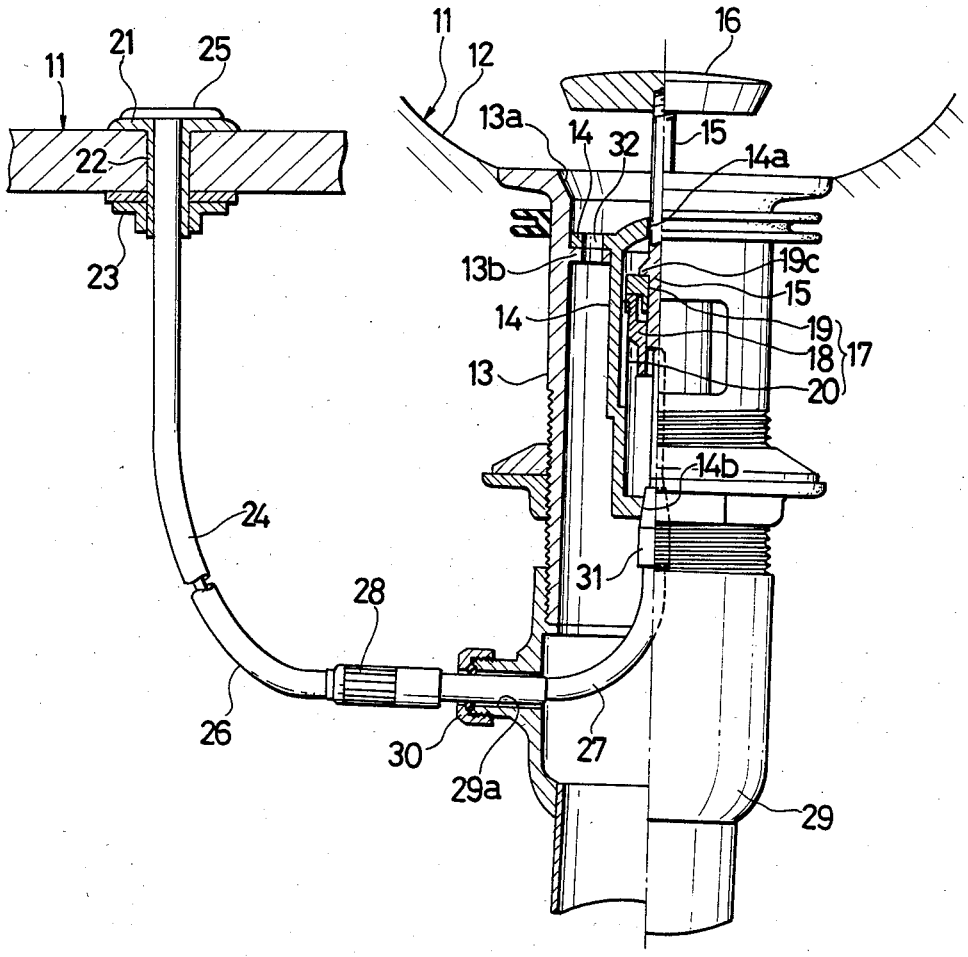
FIG. 2 shows an embodiment of a draining plug device according to the invention, in which a plug is in its closed state.
Figure 3:
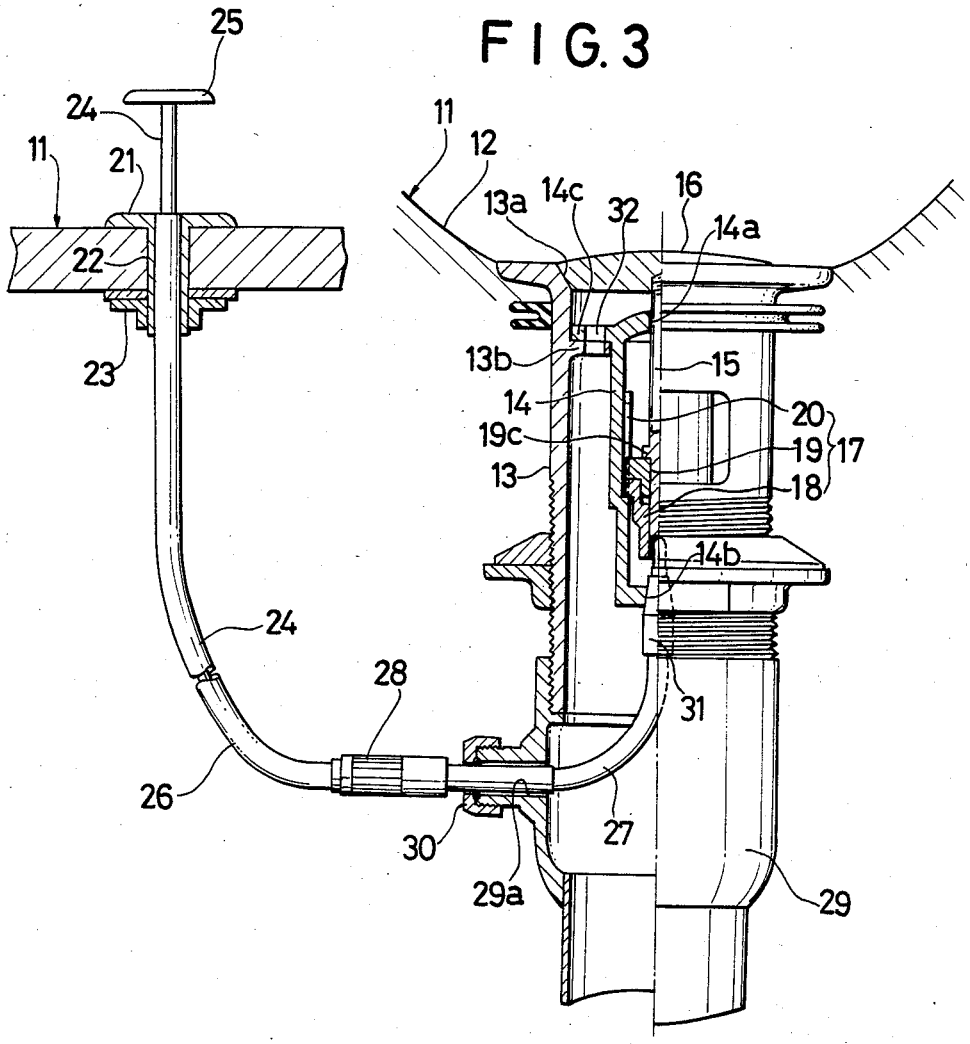
FIG. 3 shows an embodiment of a draining plug device acording to the invention, in which a plug is in its opened state.

FIG. 2 and FIG. 3 show the preferred embodiment of the invention. Numeral 11 denotes a water vessel body of a wash basin, a bathtub or the like. A drainage cylinder 13 having a flange portion 13*b* inside thereof is installed at the bottom of a water vessel 12 of the water vessel body 11. A guide cylinder 14 having ports 14*a* and 14*b* formed at upper and lower portions thereof is fixed with a screw or a pin inside the water drainage cylinder 13.

A rod shaped support (support member) 15 which extends upward and downward through the port 14*a* is provided in the guide cylinder 14. A plug lid (plug member) 16 which opens and closes the water drainage port 13*a* is fixed at the upper end of said support 15. Also, a flange shaped projection 13*b* is integrally formed at the intermediate portion of the water drainage cylinder 13.

A holding mechanism 17 which fixes and holds said support 15 at an upper position at every upward movement of the support 15 is provided between the guide cylinder 14 and the support 15. This holding mechanism consists of a fixing ring 18 fixed on the support 15, a revolving ring (rotatable ring) 19 which can revolve around the support 15, and a guide ring 20 formed integrally inside the guide cylinder 14 or connected together with the guide cylinder 14.

Figure 5:
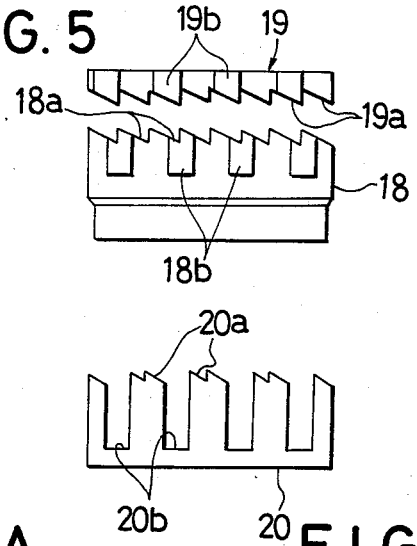
FIGS. 5 and 6A–6D are developments of the holding mechanism.
Figure 6A:
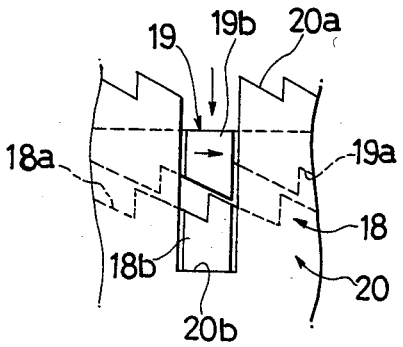
Figure 6B:
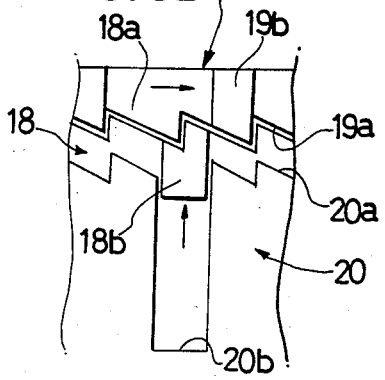
Figure 6C:
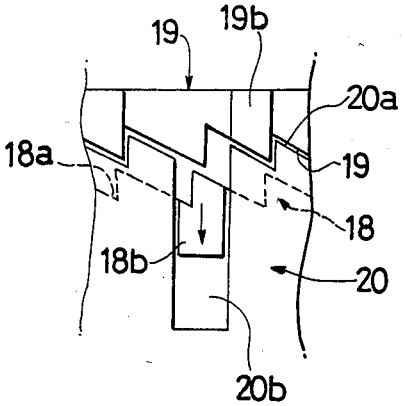
Figure 6D:
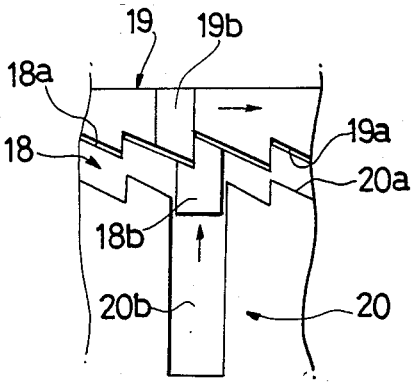

Referring to FIG. 5, sawtooth shaped teeth 18*a* are formed at the upper portion of the fixing ring 18 and projections 18*b* are formed around the periphery of the fixing ring 18. Sawtooth shaped teeth 19*a* which mate with the sawtooth shaped teeth 18*a* of the fixing ring 18 are formed on the bottom surface of the revolving ring 19. Further, projections 19*b* are formed around the periphery of the revolving ring 19. Vertical grooves 20*b* and sawtooth shaped teeth 20*a* which receive the respective projections 18*b* and 19*b* of the above mentioned fixing ring 18 and revolving ring 19 are formed alternately on the inner face of the guide ring 20.

Referring again to FIGS. 2 and 3, a support tube 22 having a cosmetic flange 21 is secured to a main body 11 with a tightening nut 23. A wire-like body or member 24 having flexibility is inserted into the support tube 22. A push button type operating portion 25 is installed at one end of said wire-like body 24 and the other end of said wire like body 24 is attached to the lower end of the support 15. The wire-like body 24 is slidably supported by guide tubes 26 and 27, and said guide tubes 26 and 27 are connected by a connecting member 28. This connecting member 28 is fixed water tightly with a sealing packing and a tightening nut 30 in an insert hole 29*a* of "T" shaped socket 29 which is screwed into the lower portion of the water drainage cylinder 13. Numeral 31 denotes a fixing member which fixes freely one end of the guide tube 27 inside a hole 14*b* of the guide cylinder 14 with a screw. Numeral 32 denotes an introduction hole formed on each of the flanges 13*b* and 14*c* of the water drainage cylinder 13 and the guide cylinder 14.

The function and effect of the invention will now be described hereunder. When the operating portion is pushed down from water the stoppage position toward the open position, the wire-like body 24 slides and pushes up the support 15. At this moment, the sawtooth shaped teeth 19*a* of the revolving ring 19 of the holding mechanism 17 come into contact with the sawtooth shaped teeth 18*a* of the fixing ring 18 and the revolving ring 19 revolves slightly, the water tightly plugged condition being changed to the opened condition. When the operating portion 25 is released, the sawtooth shaped teeth 19*a* of the revolving ring 19 engage the sawtooth shaped teeth 20*a* of the guide ring 20 and the flange 19*c* of the support 15 comes into contact with the upper surface of the revolving ring 19, as the result of which the support or the plug lid is held at the upper limit position and the plug lid 16 is kept away from the water drainage cylinder 13 so that water can can drain into cylinder 13.

When the operating portion 25 is pushed down again, the wire like body 24 pushes up the support 15. The sawtooth shaped teeth 19*a* of the revolving ring 19 come into contact with the sawtooth shaped teeth 18*a* of the fixing ring 18 and the revolving ring 19 revolves slightly. After that, the projections 19*b* enter the grooves 20*b* and the revolving ring 19 descends. As a result, the support or the plug lid is held at the lower limit position and the plug lid 16 closes the drainage port 13*a* so that water in vessel 12 is stopped from draining. As is clearly shown in the drawings, the sawteeth all consist of alternating straight line vertical and straight line angled surfaces, intersecting at a same acute angle. The vertical grooves 20*b* intersect the sawteeth 20*a* on opposite sides of the vertical grooves 20*b*.

In the disclosed embodiment of the invention, the support 15 contacts the wire-like body 24. However, these two may connected immovably.

In the drainage device of the invention, the support 15 which supports the plug lid 16 is connected to the operating portion 25 by means of the wire like body 24, and therefore the connecting portion does not wear by sliding and the like, and impact noise is not made either when the plug lid 16 is opened or closed.

According to the invention, water is stored by closing the drainage port with the plug lid and water is discharged by opening the drainage port with the plug lid being pushed up.

Conventionally, in order to open the drainage port, the plug lid was pulled off directly or the plug lid was pushed up from the back thereof for the reason that access to the plug lid was impossible. In the case of the former, it had such setbacks that the removed plug lid could not be fixed and said plug lid was pushed back to the drain port by the stream of draining water or stood in the way of discharging water.

In the latter's case, noise of operation to open the drain port gave offense to the ear.

The invention relates to the draining plug which repeats discharging and storing water by repeated opening and closing of the drain port by means of the plug lid and the support.

When the draining plug of the invention is used as mentioned above, opening and closing of the plug lid becomes smooth, and unpleasant metalic noise is not made.

Opening and closing of the plug lid is conducted by having the guide ring and support portion support the revolving ring of the support alternately. Therefore, it is possible to discharge water quantitatively. The support of the plug lid is slid by up and down sliding frame which is secured to the up and down sliding cylinder fixed inside the water drainage cylinder. Therefore, the plug lid opens and closes accurately without bending or inclining.

The invention differs from the conventional draining plug in its construction and has outstanding difference in its function and effect.

As an opening and closing mechanism which guides and supports the plug lid of the invention, the draining plug device taking advantage of the connection of a flexible wire-like body is shown as an embodiment. However, a construction using a photocell, I.C. circuit as an operating mechanism is also contained in the idea of the invention.

What is claimed is:

1. A drain plug device for opening and closing a drain port of a water drainage cylinder, comprising:

a plug member;

a support member having a first end fixed to said plug member and a second end, said plug member and said support member being vertically movable between a first position in which said plug member plugs the drain port and a second position in which said plug member is spaced from said port so that said port is open;

means for vertically guiding said support member in the drainge cylinder;

a substantially rigid curved longitudinally extending sheath;

a flexible wire-like member extending through said sheath, reciprocally movable therein toward and away from said second end of said support member, and engagable at one end thereof with said second end of said support member such that when said wire-like member is moved through said sheath towards said second end, said wire-like member engages said second end and pushes said support member and said plug member in an upward direction; and means, responsive to first reciprocal movement of said wire-like member toward and away from said second end in said sheath, for supportedly engaging said support member so as to support said plug member and said support member in said second position, said support member engaging means including means, responsive to said second reciprocal movement of said wire-like member toward and away from said second end in said sheath alternatingly with said first reciprocal movement, for releasing said support member from said second position and for guiding said support member and said plug member downward to said first position, whereby alternate reciprocal movements of said wire-like member alternately opens and closes the drain port;

said guiding means comprising a guide cylinder, having an inner surface having a center axis and surrounding said support member so as to enclose the interior of said guide cylinder, for being mounted inside the drainage cylinder in radially spaced relation thereto;

said support member engaging means comprising a fixing ring fixed on said support member, a support flange fixed on said support member above said fixing ring, a rotatable ring slidably and rotatably mounted on said support member inside said guide cylinder between said fixing ring and said support flange so as to be rotatable among alternate first and second angular orientations with respect to said axis above said fixing ring so as to be supported and raised by said fixing ring when said support member is moved in said upward direction, and a guide ring fixed on said inner surface, having means for guiding said rotatable ring and said fixing ring vertically and non-rotatably along said inner surface when said rotatable ring is in a first angular orientation;

said guide ring further comprising means for vertically supporting said rotatable ring at an upper end of said guide ring when said rotatable ring is in a first angular orientation, such that said rotatable ring supports said support flange thereon and thereby supports said support member when said rotatable ring is supported by said vertically supporting means at said upper end of said guide ring;

said rotatable ring and said fixing ring comprising means, respectively responsive to alternate ones of said first and second reciprocal movements, for automatically alternately rotating said rotatable ring between said first and second orientations;

said guide cylinder having circumferentially spaced apart radially extending upper peripheral flanges having means for fastening said guide cylinder to the drainage cylinder, and having a first opening at a top end thereof for reciprocally vertically movably receiving said support member therethrough, and a second opening at a bottom end thereof fixed to an end of said sheath so as to close said bottom end, having said one end of said wire-like member reciprocally vertically movably extending therethrough;

said rotatable ring and fixing ring guiding means comprising a plurality of uniformly spaced vertical grooves in said guide ring, a plurality of radially outwardly extending fixing ring projections integral with said fixing ring, vertically slidably extending into said grooves, and a plurality of radially outwardly extending rotatable ring projections integral with said rotatable ring, vertically slidably extending into said grooves when said rotatable ring is in said first angular orientation;

said rotatable ring rotating means comprising a plurality of first sawteeth on said guide ring between said vertical gooves, having a first predetermined angular position with respect to said axis, a plurality of second sawteeth on said fixing ring including said fixing ring projections, having a second predetermined angular position with respect to said axis angularly spaced from said first angular position, and a plurality of third sawteeth on said rotatable ring including said rotatable ring projections, alternatively matably engagable with said first sawteeth and said second sawteeth with said rotatable ring projections engaging said fixing ring projections at said second and third sawteeth when said third sawteeth matably engage with said second sawteeth;

all of the sawteeth of each of said pluralities of second and third sawteeth and all of the first sawteeth between each of said vertical grooves on said guide ring having alternating, successively intersecting surfaces, respectively straight line vertical and straight line angled in vertical cross section, all of the surfaces of said sawteeth which are angled in vertical cross section extending at a same acute angle relative to the vertical, said vertical grooves intersecting said first sawteeth on opposite sides of said vertical grooves.

* * * * *